US009885982B2

(12) United States Patent
Kojiri et al.

(10) Patent No.: US 9,885,982 B2
(45) Date of Patent: Feb. 6, 2018

(54) TRANSFER DEVICE AND IMAGE FORMING APPARATUS

(71) Applicant: FUJI XEROX CO., LTD., Tokyo (JP)

(72) Inventors: Tetsunao Kojiri, Kanagawa (JP); Yoshinori Takahashi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/205,079

(22) Filed: Jul. 8, 2016

(65) Prior Publication Data

US 2017/0205733 A1 Jul. 20, 2017

(30) Foreign Application Priority Data

Jan. 15, 2016 (JP) ..... 2016-006413

(51) Int. Cl.
*G03G 15/16* (2006.01)

(52) U.S. Cl.
CPC ..... *G03G 15/168* (2013.01); *G03G 15/161* (2013.01); *G03G 2215/1652* (2013.01)

(58) Field of Classification Search
CPC ..... G03G 15/168; G03G 15/1685; G03G 15/1665; G03G 15/167; G03G 2215/1652
See application file for complete search history.

(56) References Cited

U.S. PATENT DOCUMENTS 5,168,313 A * 12/1992 Hosaka ..... G03G 15/09 399/313
5,537,192 A * 7/1996 Iguchi ..... G03G 15/1685 399/313
7,742,721 B2 * 6/2010 Mimbu ..... G03G 15/161 399/101
8,036,550 B2 * 10/2011 Minbu ..... G03G 15/161 399/301
8,515,310 B2 * 8/2013 Nakura ..... G03G 15/0131 399/121
8,934,822 B2 * 1/2015 Mimbu ..... G03G 15/168 399/314
2002/0102115 A1 * 8/2002 Sato ..... G03G 15/1685 399/313
2006/0056884 A1 * 3/2006 Sawai ..... G03G 15/1625 399/302

(Continued)

FOREIGN PATENT DOCUMENTS

JP 2005-024692 A 1/2005
JP 2005-233991 A 9/2005
JP 2010-002564 A 1/2010

*Primary Examiner* — Carla Therrien
(74) *Attorney, Agent, or Firm* — Sughrue Mion, PLLC

(57) ABSTRACT

A transfer device includes a second transfer roller that has an elastic layer and a surface layer disposed in tight contact with an outer side of the elastic layer and rotates to transfer a toner image on a surface of an intermediate transfer body onto a recording medium, a scraping member that is in contact with the second transfer roller to scrape an attached substance off the surface layer, and a pressed member that is pressed against the surface layer on a downstream side of a contact portion with the intermediate transfer body and on an upstream side of the scraping member in a rotating direction of the second transfer roller and rotates in a forward direction with respect to rotation of the second transfer roller.

10 Claims, 7 Drawing Sheets

(56) References Cited

U.S. PATENT DOCUMENTS

2013/0315620 A1* 11/2013 Kikuchi ..... G03G 15/751
399/111
2014/0086630 A1* 3/2014 Kitajima ..... G03G 21/1839
399/111
2014/0270839 A1* 9/2014 Matsumoto ..... G03G 15/168
399/101

* cited by examiner

| | | SECOND EXAMPLE | COMPARATIVE EXAMPLE |
|---|---|---|---|
| | CLEANING MEMBER | TWO-LAYER CLEANING BLADE | TWO-LAYER CLEANING BLADE |
| | PRESSED MEMBER | PROVIDED | NOT PROVIDED |
| PAPER NON-PASSING PART | IMAGE FORMED | ○ (G0) | × (G4) |
| PAPER PASSING PART | IMAGE FORMED | ○ (G0) | × (G4) |

TRANSFER DEVICE AND IMAGE FORMING APPARATUS

CROSS-REFERENCE TO RELATED APPLICATIONS

This application is based on and claims priority under 35 USC 119 from Japanese Patent Application No. 2016-006413 filed Jan. 15, 2016.

BACKGROUND

(i) Technical Field

The present invention relates to a transfer device and an image forming apparatus.

(ii) Related Art

In a transfer device including a second transfer roller in which a surface layer is in tight contact with an outer side of an elastic layer without being bonded, when a scraping member touches a surface of the second transfer roller, so-called filming, in which a toner component thinly adheres to the surface layer on the outer side of the elastic layer in the second transfer roller, is sometimes caused by waviness of the surface layer.

SUMMARY

According to an aspect of the invention, there is provided a transfer device including a second transfer roller that has an elastic layer and a surface layer disposed in tight contact with an outer side of the elastic layer and rotates to transfer a toner image on a surface of an intermediate transfer body onto a recording medium, a scraping member that is in contact with the second transfer roller to scrape an attached substance off the surface layer, and a pressed member that is pressed against the surface layer on a downstream side of a contact portion with the intermediate transfer body and on an upstream side of the scraping member in a rotating direction of the second transfer roller and rotates in a forward direction with respect to rotation of the second transfer roller.

BRIEF DESCRIPTION OF THE DRAWINGS

Exemplary embodiments of the present invention will be described in detail based on the following figures, wherein.

DETAILED DESCRIPTION

Image forming apparatuses according to exemplary embodiments of the present invention will be described below with reference to the drawings.

Figure 1:
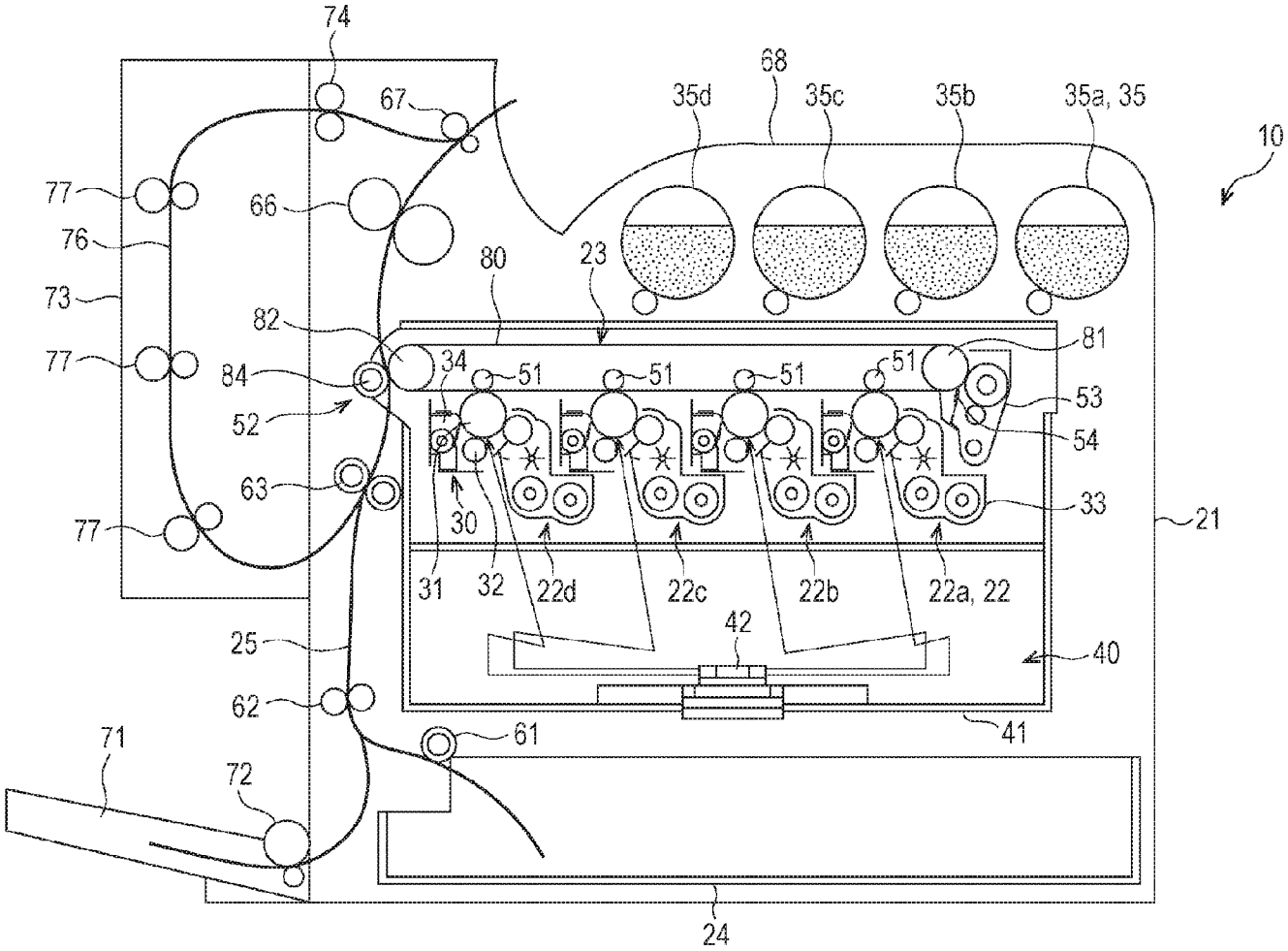
FIG. 1 is a structural view of an image forming apparatus including a transfer device according to a first exemplary embodiment of the present invention.

FIG. 1 is a structural view of an image forming apparatus according to a first exemplary embodiment, that is, a so-called tandem image forming apparatus 10.

As illustrated in FIG. 1, in the image forming apparatus 10, image forming units 22 for four colors of yellow, magenta, cyan, and black (specifically, image forming units 22*a*, 22*b*, 22*c*, and 22*d*) are provided inside a body housing 21, and a belt module 23 disposed along an arrangement direction of the image forming units 22 is provided above the image forming units 22. Further, in the image forming apparatus 10, a cassette 24 in which recording media such as paper (not illustrated) are stored is provided in a lower part of the body housing 21, and a transport path 25 through which the recording media are transferred extends upward from the cassette 24.

For example, the image forming units 22 form toner images of yellow, magenta, cyan, and black in this order from the upstream side in the circling direction of an intermediate transfer belt 80 (the arrangement order is not always limited to this order). The image forming units 22 include their respective photoconductor units 30 and developing units 33 and one common exposure unit 40. Each of the photoconductor units 30 includes a photoconductor drum 31, a charging roller 32 that charges the photoconductor drum 31, and a cleaning device 34 that removes residual toner from the photoconductor drum 31. The exposure unit 40 stores, inside a unit case 41, for example, four semiconductor lasers (not illustrated), one polygonal mirror 42, an imaging lens (not illustrated), and mirrors (not illustrated) each corresponding to one of the photoconductor units 30. Each of the developing units 33 develops an electrostatic latent image formed on the photoconductor drum 31 by exposure by the exposure unit 40 with corresponding color toner (for example, having a negative polarity). In an upper part of the body housing 21, toner cartridges 35 (specifically, toner cartridges 35*a*, 35*b*, 35*c*, and 35*d*) are provided to supply color component toners to the developing units 33.

The belt module 23 is structured by stretching an intermediate transfer belt 80 serving as an example of an intermediate transfer body between a pair of support rollers 81 and 82 (one of them is a driving roller). First transfer rollers 51 are disposed on a back surface of the intermediate transfer belt 80 correspondingly to the photoconductor drums 31 of the photoconductor units 30. By applying a voltage having a polarity opposite from the toner charging polarity to the first transfer rollers 51, toner images on the photoconductor drums 31 are electrostatically transferred onto the intermediate transfer belt 80. Further, a transfer device 52 that forms a transfer unit is disposed at a position corresponding to the support roller 82 on the downstream side of the image forming unit 22*d* provided on the most downstream side of the intermediate transfer belt 80, and second-transfers (collectively transfers) the toner images on the surface of the intermediate transfer belt 80 onto a recording medium.

The transfer device 52 includes a second transfer roller 84 disposed in pressure contact with a toner-image bearing surface of the intermediate transfer belt 80 and a back roller disposed on the back side of the intermediate transfer belt 80 and serving as an opposed electrode for the second transfer roller 84 (this roller also functions as the support roller 82 in the first exemplary embodiment). For example, the second transfer roller 84 is grounded, and a bias having the same polarity as the toner charging polarity is applied to the back roller (support roller 82).

A belt cleaning device 53 is disposed on the upstream side of the image forming unit 22*a* provided on the most upstream side of the intermediate transfer belt 80, and removes residual toner from the intermediate transfer belt 80 with a cleaning blade 54.

The cassette 24 is provided with a feeding roller 61 that feeds out recording media. A transport roller 62 that transports the recording media is disposed just downstream of the feeding roller 61, and a registration roller 63 that supplies the recording media to a second transfer portion (transfer unit) at a predetermined timing is disposed in the transport path 25 located just upstream of the second transfer portion. A fixing device 66 is provided in the transport path 25 downstream of the second transfer portion, and an output roller 67 is provided downstream of the fixing device 66. This output roller 67 outputs the recording media into a paper output section 68 in the upper part of the body housing 21.

A manual supply device 71 is provided on a side of the body housing 21. A recording medium on the manual supply device 71 is transported toward the transport path 25 by a feeding roller 72 and the transport roller 62. Further, the body housing 21 is provided with a duplex recording unit 73. When a duplex mode for recording images on both surfaces of a recording medium is selected, the duplex recording unit 73 reverses a recording medium having one recorded surface by the output roller 67, takes in the recording medium by a guide roller 74 before the entrance, transports the recording medium along an internal recording-medium return transport path 76 by transport rollers 77, and supplies the recording medium toward the registration roller 63 again.

Next, the transfer device 52 disposed inside the image forming apparatus 10 will be described.

Figure 2:
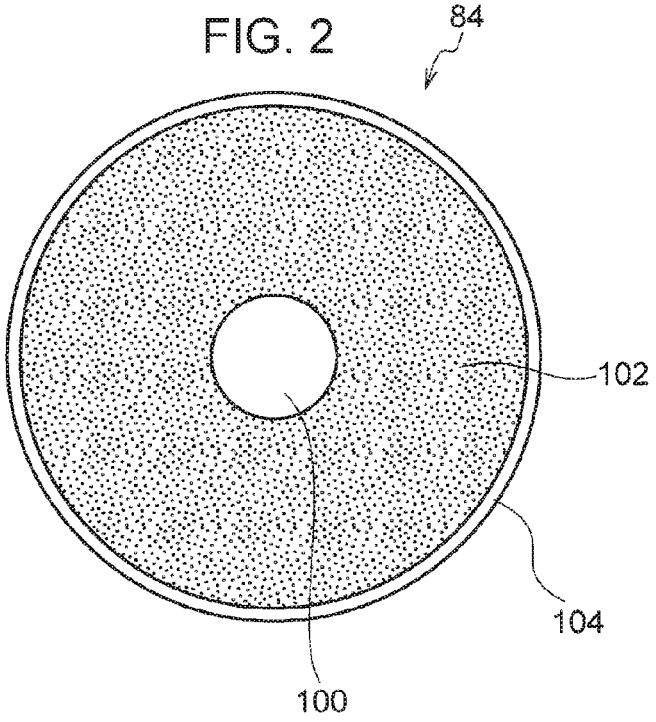
FIG. 2 is a cross-sectional view of a second transfer roller used in the image forming apparatus illustrated in FIG. 1, taken along a direction orthogonal to an axial direction.

FIG. 2 is a cross-sectional view of the second transfer roller 84 used in the transfer device 52 of the first exemplary embodiment, taken along a direction orthogonal to the axial direction. As illustrated in FIG. 2, the second transfer roller 84 includes a shaft portion 100 disposed in the longitudinal direction, an elastic layer 102 provided around the shaft portion 100, and a surface layer 104 disposed in tight contact with an outer side of the elastic layer 102. An adhesive layer is not provided between the surface layer 104 and the elastic layer 102, and the surface layer 104 and the elastic layer 102 are not bonded to each other. The second transfer roller 84 transfers a toner image on the surface of the intermediate transfer belt 80 onto a recording medium when the recording medium is transported to a contact portion between the second transfer roller 84 and the intermediate transfer belt 80.

Although not illustrated, the axial length of the shaft portion 100 is set to be larger than the axial length of the elastic layer 102 and the surface layer 104. Both axial end portions of the shaft portion 100 are supported by unillustrated bearings so that the second transfer roller 84 rotates in a direction of arrow A (see FIG. 3). The second transfer roller 84 may rotate to follow movement of the intermediate transfer belt 80, or may be independently rotated in the direction of arrow A.

The elastic layer 102 is formed of a material that is softer (elastic modulus is lower) than the shaft portion 100, for example, foamed resin. In the first exemplary embodiment, the elastic layer 102 is formed of conductive foamed polyurethane, and the thickness thereof is set at, for example, about 4 mm. For example, the Asker C hardness of the elastic layer 102 is set at 30° to 40°, and preferably at 35°. The Asker C hardness is measured by pressing a measurement needle of an Asker C hardness meter (manufactured by Kobunshi Keiki Co., Ltd.) against a surface of a measurement sheet of a thickness of 3 mm serving as a sample of the elastic layer 102 under conditions of 22° C. and 55% RH with a load of 0.5 kg.

The surface layer 104 is formed of a material that is harder than the elastic layer 102 and has a smooth surface. The surface layer 104 is formed by a resin tube (covering tube) that covers the elastic layer 102. In the first exemplary embodiment, for example, the surface layer 104 is formed of conductive polyimide, and the thickness of the surface layer 104 is set at about 40 μm.

As a manufacturing method for the second transfer roller 84, for example, a method for press-fitting an elastic roller having the elastic layer 102 into a covering tube that forms the surface layer 104 is adopted.

Figure 3:
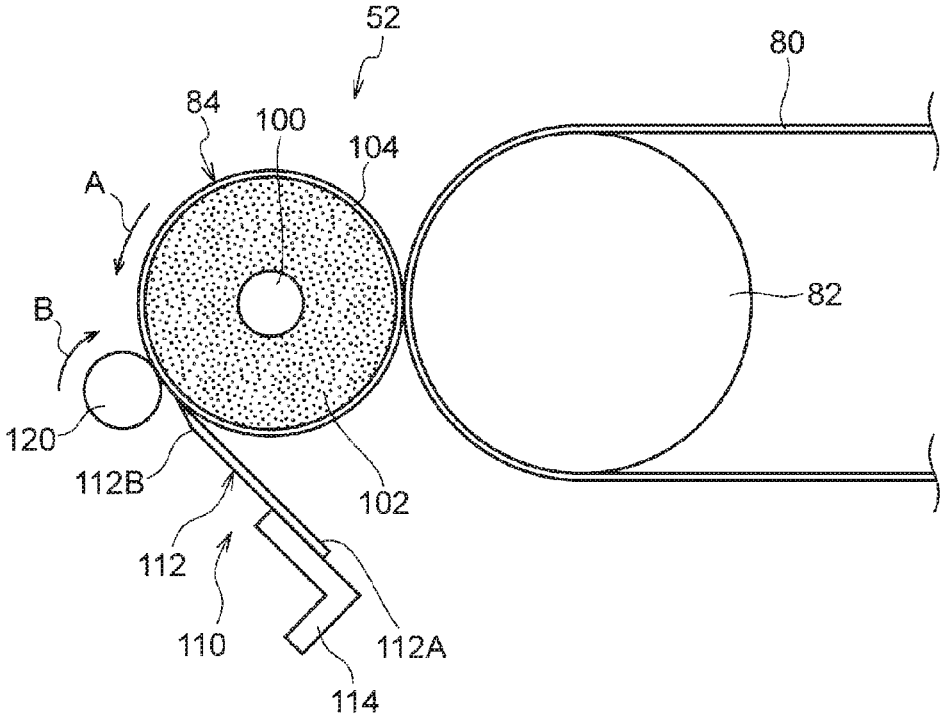
FIG. 3 is a structural view of the transfer device used in the image forming apparatus illustrated in FIG. 1.
Figure 4:
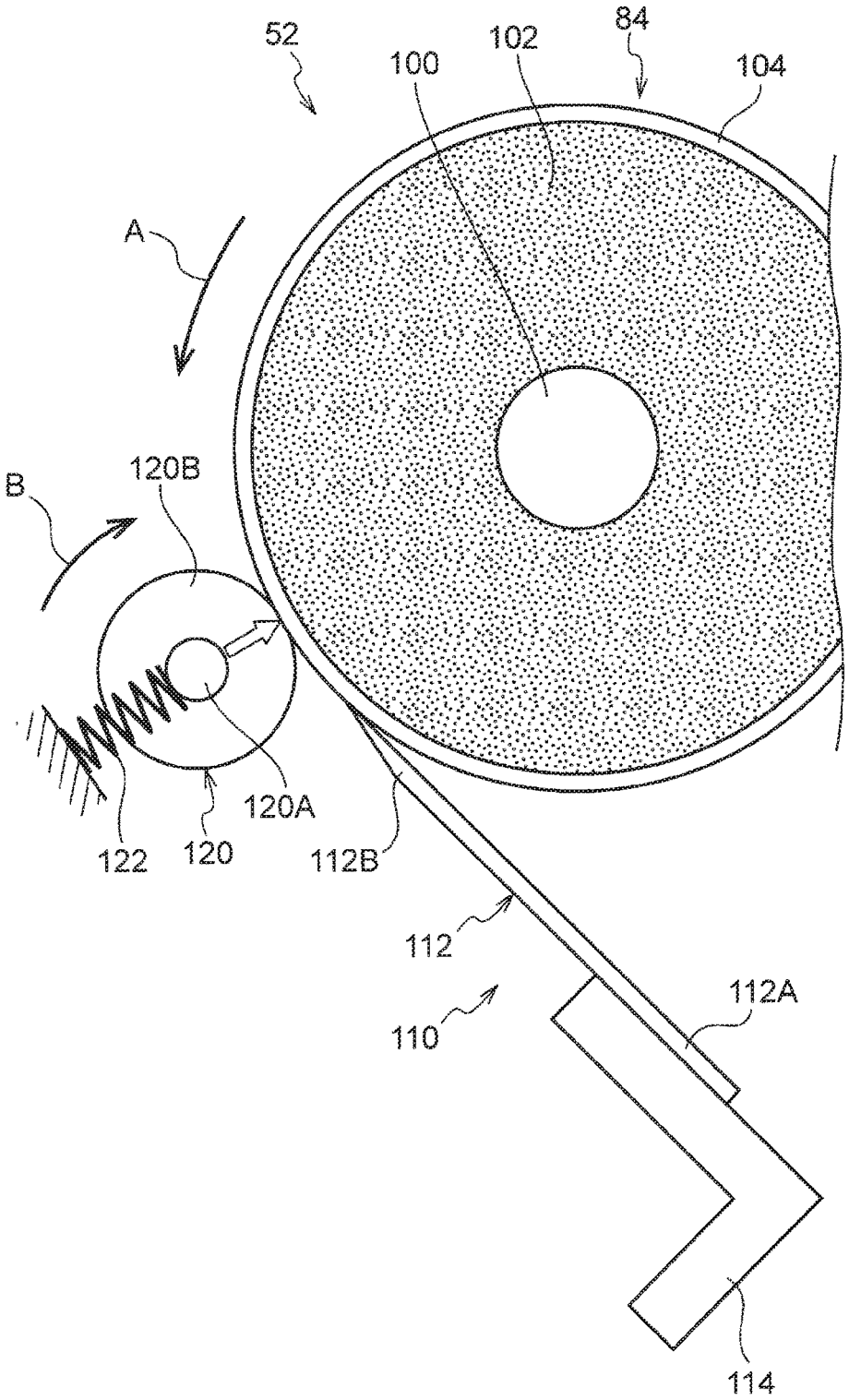
FIG. 4 is a structural view of the surroundings of a pressed member in the transfer device used in the image forming apparatus illustrated in FIG. 3.

FIG. 3 illustrates the transfer device 52 of the first exemplary embodiment, and FIG. 4 illustrates the surrounding of a pressed member 120 used in the transfer device 52. As illustrated in FIGS. 3 and 4, the transfer device 52 includes the second transfer roller 84 and a cleaning member 110 serving as an example of a scraping member that is in contact with the surface of the second transfer roller 84 to scrape attached substances off the surface of the second transfer roller 84. The transfer device 52 further includes a roll-shaped pressed member 120 that is pressed against the surface layer 104 on the downstream side of the contact portion with the intermediate transfer belt 80 and on the upstream side of the cleaning member 110 in the rotating direction of the second transfer roller 84.

The cleaning member 110 includes a scraper 112 serving as an example of an abutting member that is in contact with the second transfer roller 84 with pressure to scrape attached substances off the surface of the second transfer roller 84, and a support portion 114 that supports the scraper 112. The support portion 114 is L-shaped in a side cross section. A root portion 112A of the scraper 112 is fixed to one end portion of the support portion 114, and the other end portion of the support portion 114 is fixed to a housing (not illustrated) of the transfer device 52. The second transfer roller 84 rotates in the direction of arrow A, and a distal end portion 112B of the scraper 112 is disposed in a posture such as to point toward the upstream side in the rotating direction of the second transfer roller 84.

The scraper 112 is formed by a metallic platelike member. While the distal end portion 112B of the scraper 112 in contact with the second transfer roller 84 has a pointed shape, the shape of the distal end portion 112B of the scraper 112 may be changed. In the first exemplary embodiment, an etched product of SUS 304 (TA material) is used as the scraper 112. The thickness of the scraper 112 is about 80 μm, and the length of a portion of the scraper 112 that is not restrained by the support portion 114 (length from a portion of the scraper 112 with no support portion 114 to the distal end portion 112B) is 7.5 mm. In FIGS. 3 and 4, the thickness of the scraper 112 is larger than the actual one so that the structure of the scraper 112 is easily understood.

As illustrated in FIG. 4, the pressed member 120 includes a shaft portion 120A and an outer peripheral portion 120B provided on an outer side of the shaft portion 120A. Both axial end portions of the shaft portion 120A are supported by unillustrated bearings so that the pressed member 120 rotates in the forward direction (direction of arrow B) with respect to the rotation of the second transfer roller 84. In other words, the pressed member 120 rotates in the same direction as the rotating direction of the second transfer roller 84 at the contact portion with the second transfer roller 84. In the first exemplary embodiment, the pressed member 120 rotates in the forward direction (direction of arrow B) by following the rotation of the second transfer roller 84.

Spring members 122 are provided at both axial end portions of the shaft portion 120A in the pressed member 120, and the pressed member 120 is biased toward the second transfer roller 84 by the spring members 122. That is, the pressed member 120 is pressed against the surface layer 104 of the second transfer roller 84 by the spring members 122.

In the transfer device 52 of the first exemplary embodiment, the pressed member 120 is disposed at the position on the upstream side of the cleaning member 110 in the rotating direction of the second transfer roller 84 and just before the contact portion of the surface layer 104 of the second transfer roller 84 with the cleaning member 110.

In the first exemplary embodiment, the outer peripheral portion 120B of the pressed member 120 is formed of, for example, synthetic resin. The material of the outer peripheral portion 120B is not limited to synthetic resin, and, for example, the outer peripheral portion 120B may be formed of metal, foamed resin, or a composite member obtained by combining two or more of metal, resin, and foamed resin.

In the transfer device 52, the pressed member 120 is pressed against the surface layer 104 of the second transfer roller 84 on the downstream side of the contact portion with the intermediate transfer belt 80 and on the upstream side of the cleaning member 110 in the rotating direction of the second transfer roller 84. Thus, the maximum wave height Wz of the surface layer 104 of the second transfer roller 84 is less than or equal to ½ of the toner volume average particle diameter at the contact portion of the cleaning member 110 with the surface layer 104 of the second transfer roller 84. In the first exemplary embodiment, for example, the toner volume average particle diameter is 5 μm, and the maximum wave height Wz of the surface layer 104 of the second transfer roller 84 is 2.5 μm or less. More specifically, the maximum wave height Wz of the surface layer 104 is preferably within the range of 1.0 to 2.5 μm, more preferably within the range of 1.0 to 2.3 μm, and further preferably within the range of 1.0 to 2.0 μm.

Here, the maximum wave height Wz refers to the maximum height of a waviness curve of the surface layer 104, and to the sum of the maximum peak height Zp and the maximum valley depth Zv of a contour curve in a reference length. The maximum wave height Wz is measured according to JIS-B0601'2001. In the first exemplary embodiment, the filtered center waviness (filtered waviness curve) of the surface layer 104 is measured in a measurement length of 40 mm by using a surface texture and contour measuring instrument Surfcom (manufactured by Tokyo Seimitsu Co., Ltd.). The maximum wave height Wz is measured at plural portions on the surface layer 104 in the axial direction, and the average value of the maximum wave heights is calculated.

A particle distribution measuring device (Coulter Multisizer II: manufactured by Beckman Coulter, Inc.) is used as a device for measuring the toner volume average particle diameter, and the particle diameter is measured using ISOTON-II (manufactured by Beckman Coulter, Inc.) as an electrolyte. As a measurement method, 0.5 to 50 mg of a measurement sample is added to 2 ml of a 5% water solution of a surface-active agent, preferably sodium alkylbenzene sulfonate, as a dispersant, and the mixture is added to 100 to 150 ml of electrolyte. This electrolyte in which the measurement sample is suspended is subjected to dispersion for about one minute with an ultrasonic disperser, and the particle size distribution is measured with Caulter Multisizer II by using an aperture having an aperture diameter of 100 μm. The number of particles to be measured is 50000. A cumulative distribution of the measured particle size distribution is obtained from the small-diameter side in divided particle size ranges (channels), the particle size at a cumulative volume of 50% is defined as a volume average particle diameter D50v, and D50v is taken as the volume average particle diameter.

Figures 8, 9:
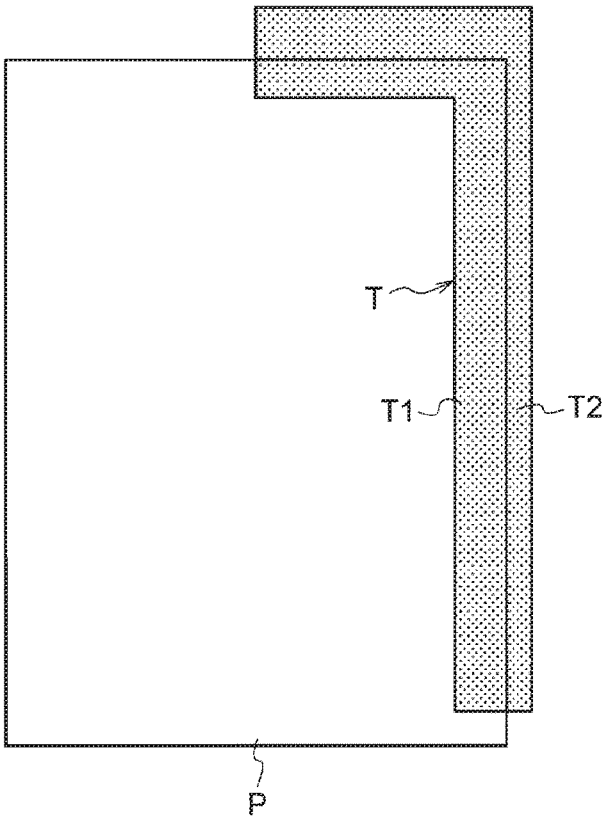
FIG. 8 is a plan view illustrating a print pattern in which a part of a toner image on an intermediated transfer belt is transferred on a region of a recording medium including edges.
FIG. 9 is a table comparing the occurrence state of filming on the surface of the second transfer roller between an example in which a pressed member is provided to be pressed against the second transfer roller and a comparative example in which the pressed member to be pressed against the second transfer roller is not provided.

In the image forming apparatus 10 of the first exemplary embodiment, for example, so-called marginless printing is performed to transfer a part of a toner image on the surface of the intermediate transfer belt 80 onto a region of a recording medium including edges by the second transfer roller 84 (see FIG. 8). Instead of marginless printing, normal printing may be performed so that the toner image on the surface of the intermediate transfer belt 80 is transferred by the second transfer roller 84 onto a region of the recording medium including no edges.

Next, a transfer device according to a second exemplary embodiment of the present invention will be described with reference to FIG. 5. The same components as those adopted in the above-described first exemplary embodiment are denoted by the same reference numerals, and descriptions thereof are skipped.

Figure 5:
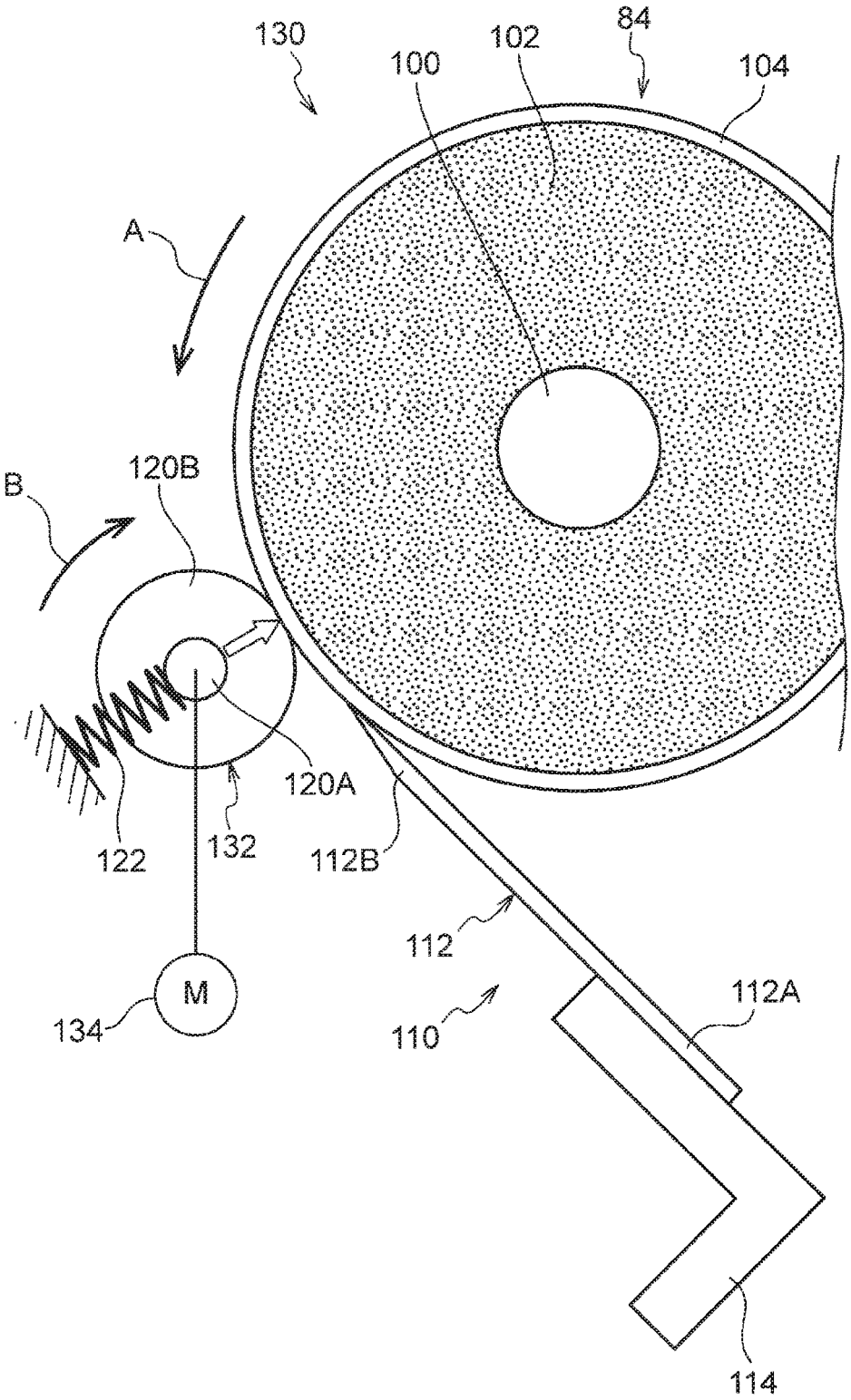
FIG. 5 is a structural view of a transfer device according to a second exemplary embodiment of the present invention.

As illustrated in FIG. 5, a transfer device 130 includes, instead of the pressed member 120 of the first exemplary embodiment (see FIG. 3), a roll-shaped pressed member 132 that is pressed against a surface layer 104 of a second transfer roller 84 on the downstream side of a contact portion with an intermediate transfer belt 80 (not illustrated) and on the upstream side of a cleaning member 110 in the rotating direction of the second transfer roller 84. Further, the transfer device 130 includes a motor 134 serving as an example of a driving unit that drives the pressed member 132 in the forward direction (direction of arrow B) with respect to rotation of the second transfer roller 84.

Next, a transfer device according to a third exemplary embodiment of the present invention will be described with reference to FIG. 6. The same components as those adopted in the above-described first and second exemplary embodiments are denoted by the same reference numerals, and descriptions thereof are skipped.

Figure 6:
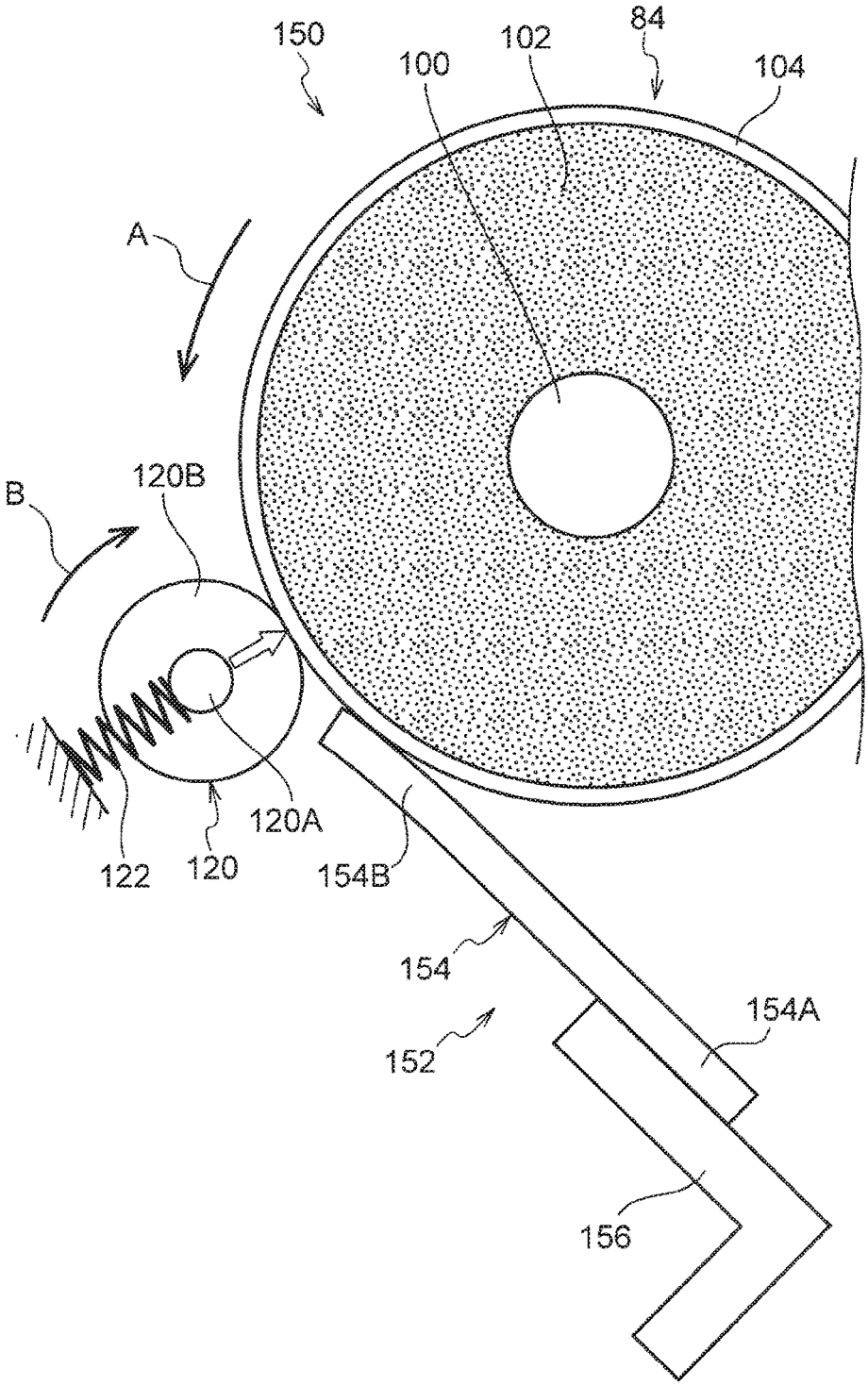
FIG. 6 is a structural view of a transfer device according to a third exemplary embodiment of the present invention.

As illustrated in FIG. 6, a transfer device 150 includes, instead of the cleaning member 110 of the first exemplary embodiment (see FIG. 3), a cleaning member 152 serving as an example of a scraping member that is in contact with a surface of a second transfer roller 84 to scrape attached substances off the surface of the second transfer roller 84.

The cleaning member 152 includes a cleaning blade 154 that is in contact with the second transfer roller 84 with pressure (in an elastically deformed state) to scrape attached substances off the surface of the second transfer roller 84, and a support portion 156 that supports the cleaning blade 154. The support portion 156 is L-shaped in a side cross section. A root portion 154A of the cleaning blade 154 is fixed to one end portion of the support portion 156, and the other end portion of the support portion 156 is fixed to a housing (not illustrated) of the transfer device 150. The second transfer roller 84 rotates in a direction of arrow A, and a distal end portion 154B of the cleaning blade 154 is disposed in a posture such as to point toward the upstream side in the rotating direction of the second transfer roller 84.

For example, the cleaning blade 154 is formed by a rectangular two-layer blade, and includes a cleaning layer in contact with the second transfer roller 84 and a back layer disposed on the back side of the cleaning layer. In the cleaning blade 154 of the third exemplary embodiment, the cleaning layer in contact with the second transfer roller 84 is formed by a rubber member having a thickness of about 0.5 mm, and the back layer is formed by a rubber member having a thickness of about 1.5 mm and having a hardness lower than that of the cleaning layer. The cleaning blade 154 does not always need to be composed of two layers, and, for example, may be formed by a single layer.

While the specific exemplary embodiments of the present invention have been described in detail, it is obvious to those skilled in the art that the present invention is not limited to these exemplary embodiments and that various exemplary embodiments can be adopted within the scope of the invention.

EXAMPLES

First Example

Next, a description will be given of an experiment conducted to investigate the slip amount of toner that passes through the cleaning member while changing the maximum wave height Wz of a surface layer 104 of a second transfer roller 84 in an image forming apparatus 10 of a first example.

In the image forming apparatus 10 of the first example, a mat image is transferred onto a recording medium P by the second transfer roller 84, the image forming apparatus 10 is stopped at a time when the mat image passes through a cleaning member 110 (or cleaning member 152) in a first transfer cycle of the second transfer roller 84, and the state of the surface layer 104 of the second transfer roller 84 (toner slip amount) at the position where the mat image passes through the cleaning member 110 (or cleaning member 152) is observed.

In this experiment, the maximum wave height Wz of the surface layer 104 of the second transfer roller 84 is changed by changing the condition for pressing a pressed member 120 against the second transfer roller 84.

As a method for measuring the maximum wave height Wz, after the second transfer roller 84 passes through the pressed portion of the pressed member 120, the maximum wave height Wz of the surface layer 104 is measured at the contact position where the second transfer roller 84 touches the cleaning member 110 (or cleaning member 152). Specifically, in a state in which the pressed member 120 is set on the second transfer roller 84, the cleaning member 110 (or cleaning member 152) is removed, and the maximum wave height Wz of the surface layer 104 at the position where the second transfer roller 84 touches the cleaning member 110 (or cleaning member 152) is measured. The maximum wave height Wz is measured according to JIS-B0601'2001. In the first example, the filtered center waviness (filtered waviness curve) of the surface layer 104 is measured with the surface texture and contour measuring instrument Surfcom (manufactured by Tokyo Seimitsu Co., Ltd.), and the measurement length is 40 mm.

As the toner, toner having a volume average particle diameter of 5 μm is used. As described above, the volume average particle diameter of the toner is measured with the particle distribution measuring device (Coulter Multisizer II: manufactured by Beckman Coulter, Inc.) by using ISOTON-II (manufactured by Beckman Coulter, Inc.) as an electrolyte.

The maximum wave height Wz of the surface layer 104 of the second transfer roller 84 is measured for a case in which cleaning member 152 having the cleaning blade 154 is used as the cleaning member and a case in which the cleaning member 110 having the scraper 112 is used as the cleaning member.

Figure 7:
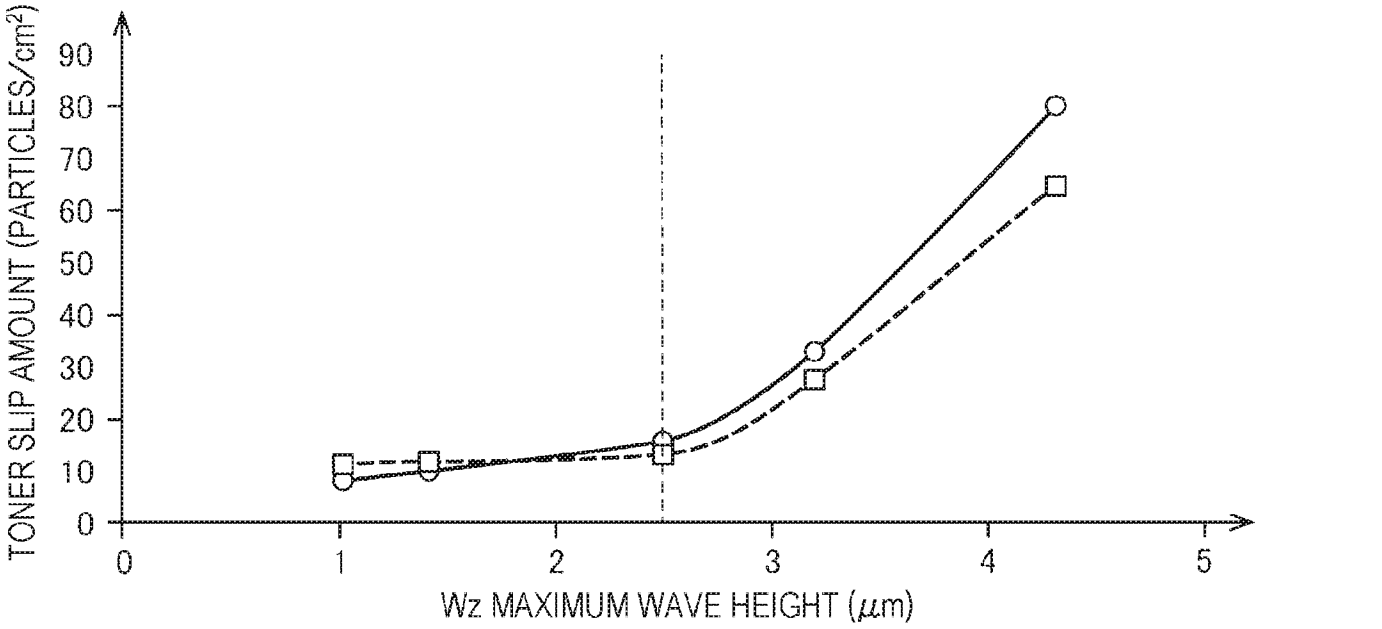
FIG. 7 is a graph showing the relationship between the maximum wave height of the surface layer of the second transfer roller and the toner slip amount.

FIG. 7 is a graph showing the relationship between the maximum wave height Wz (μm) of the surface layer 104 of the second transfer roller 84 and the toner slip amount (particles/$cm^2$). As shown in FIG. 7, when the maximum wave height Wz of the surface layer 104 of the second transfer roller 84 is 2.5 μm or less, toner slipping from the cleaning members 110 and 154 on the surface of the second transfer roller 84 is suppressed. In FIG. 7, when the maximum wave height Wz of the surface layer 104 of the second transfer roller 84 is 4.3 μm, the pressed member 120 is not provided (the pressed member 120 is not in contact with the second transfer roller 84). That is, when the maximum wave height Wz of the surface layer 104 is less than or equal to about ½ of the volume average particle diameter of the toner, the toner slip amount before the method of the first example is performed (when the pressed member 120 is not provided) is reduced by about 80%. When the maximum wave height Wz of the surface layer 104 is 2.5 μm or less, the toner slip amount is substantially equal to when filming does not occur and the maximum wave height Wz of the surface layer 104 is 1.0 μm.

Second Example

A description will be given of an experiment in which, after ten thousand A4-sized recording media P are printed in a print pattern illustrated in FIG. 8 by an image forming apparatus 10 of a second example, the surface of a second transfer roller 84 is observed to check the filming state.

As illustrated in FIG. 8, in the second example, an L-shaped toner image T is formed on an intermediate transfer belt 80 (see FIG. 1), and a part T1 of the toner image T on the intermediate transfer belt 80 is transferred on a region of a recording medium (paper in the second example) P including edges (marginless printing). A toner image T2 is not on the recording medium P, and the toner image T2 not on the recording medium P adheres to the second transfer roller 84.

As a cleaning member 152 for cleaning the surface of the second transfer roller 84 (see FIG. 6), a cleaning blade 154 formed by a two-layer blade is used. In the cleaning blade 154, a cleaning layer in contact with the second transfer roller 84 is formed by a rubber member having a thickness of about 0.5 mm, and a back layer is formed by a rubber member having a thickness of about 1.5 mm and having a hardness less than that of the cleaning layer.

In the second example, the surface of the second transfer roller 84 is observed to check the filming state in the structure in which the pressed member 120 is pressed against the surface of the second transfer roller 84. Further, as a comparative example, the surface of the second transfer roller 84 is observed to check the filming state in a structure in which the pressed member 120 is not provided on the surface of the second transfer roller 84.

As the pressed member 120, a roll-shaped pressed member 120 having a diameter of 2 mm and made of metal (SUS in the second example) is used, the biting amount of the pressed member 120 in the second transfer roller 84 is 0.8 mm, and the distance to the measurement portion (contact portion of the cleaning member 152) is 1.0 mm.

In the structure of the second example (in which the pressed member 120 is pressed against the surface of the second transfer roller 84), the maximum wave height Wz of the surface layer 104 is 1.33 μm at the position where the second transfer roller 84 is in contact with the cleaning member 152. In the structure of the comparative example (in which the pressed member 120 is not provided on the surface of the second transfer roller 84), the maximum wave height Wz of the surface layer 104 is 4.32 μm at the position where the second transfer roller 84 is in contact with the cleaning member 152. The maximum wave height Wz is measured according to JIS-B0601'2001. In the second example, the filtered center waviness (filtered waviness curve) of the surface layer 104 is measured with the surface texture and contour measuring instrument Surfcom (manufactured by Tokyo Seimitsu Co., Ltd.), and the measurement length is 40 mm.

In the comparative example, marginless printing is performed under the same print condition as that of the second example, and the occurrence state of filming on the surface of the second transfer roller is checked.

FIG. 9 shows the occurrence states of filming on the surface of the second transfer roller 84 in the second example and the comparative example. In FIG. 9, "IMAGE FORMED" in "PAPER PASSING PART" corresponds to a portion where the part T1 of the toner image T illustrated in FIG. 8 is transferred on the recording medium P, and "IMAGE FORMED" in "PAPER NON-PASSING PART" corresponds to a portion where the toner image T2 which is not on the recording medium P in FIG. 8 is transferred. The occurrence state of filming is evaluated in six grades G0 to G5 from a state in which no filming occurs to a state in which much filming occurs through a state in which little filming occurs.

As shown in FIG. 9, in the image forming apparatus of the second example, it is confirmed that the occurrence state of filming on the surface of the second transfer roller 84 is G0, that is, good (○ in FIG. 9). In contrast, in the image forming apparatus of the comparative example, it is confirmed that the occurrence state of filming on the surface of the second transfer roller 84 is G4, that is, the filming occurrence state becomes worse than in the second example (x in FIG. 9).

What is claimed is:

1. A transfer device comprising:

a second transfer roller that has an elastic layer and a surface layer disposed in tight contact with an outer side of the elastic layer, without being bonded to the elastic layer, and is configured to rotate to transfer a toner image on a surface of an intermediate transfer body onto a recording medium;

a scraping member configured to contact the second transfer roller to scrape an attached substance off the surface layer; and a pressed member configured to press against the surface layer on a downstream side of a contact portion with the intermediate transfer body and on an upstream side of the scraping member in a rotating direction of the second transfer roller and configured to rotate in a forward direction with respect to rotation of the second transfer roller, wherein a maximum wave height of the surface layer of the second transfer roller at a contact position with the scraping member is less than or equal to ½ of a volume average particle diameter of toner.

2. The transfer device according to claim 1, further comprising:

a driving unit configured to drive the pressed member in the forward direction with respect to the rotation of the second transfer roller.

3. The transfer device according to claim 2, wherein a metallic plate member is used as the scraping member.

4. The transfer device according to claim 1, wherein a metallic plate member is used as the scraping member.

5. An image forming apparatus comprising the transfer device according to claim 1, wherein a part of the toner image on the surface of the intermediate transfer body is configured to be transferred onto a region of the recording medium including an edge by the second transfer roller.

6. The transfer device according to claim 1, wherein the scraping member comprises:

a cleaning layer configured to contact the second transfer roller; and a back layer disposed on a back side of the cleaning layer.

7. The transfer device according to claim 1, further comprising:

a spring member configured to bias the pressed member toward the second transfer roller.

8. The transfer device according to claim 1, wherein the elastic layer comprises foamed polyurethane having an Asker C hardness of between 30° and 40°.

9. The transfer device according to claim 1, wherein the surface layer comprises conductive polyimide.

10. The transfer device according to claim 1, wherein the maximum wave height of the surface layer of the second transfer roller is measured over a measurement length of 40 mm.

* * * * *